US009631422B1

(12) United States Patent
Chen

(10) Patent No.: US 9,631,422 B1
(45) Date of Patent: Apr. 25, 2017

(54) ROLLER SHADE WITH A LIGHT REGULATING FUNCTION

(71) Applicant: CALENDAR ENTERPRISES CO., LTD., Chang-Hwa Hsien (TW)

(72) Inventor: Ju-Huai Chen, Chang-Hwa Hsien (TW)

(73) Assignee: Calendar Enterprises Co., Ltd., Chang-Hwa Hsien (TW)

( * ) Notice: Subject to any disclaimer, the term of this patent is extended or adjusted under 35 U.S.C. 154(b) by 0 days.

(21) Appl. No.: 15/011,714

(22) Filed: Feb. 1, 2016

(51) Int. Cl.
*E06B 9/42* (2006.01)
*E06B 9/58* (2006.01)
*E06B 9/24* (2006.01)

(52) U.S. Cl.
CPC ..... *E06B 9/42* (2013.01); *E06B 9/58* (2013.01); *E06B 2009/2417* (2013.01); *E06B 2009/2447* (2013.01)

(58) Field of Classification Search
CPC ... G09F 11/24; E06B 9/40; E06B 9/34; E06B 9/262; E06B 9/64; E06B 9/66; E06B 9/42
USPC ..... 160/121.1, 241, 85, 86
See application file for complete search history.

(56) References Cited

U.S. PATENT DOCUMENTS 2,142,822 A * 1/1939 Moore ..... A47H 23/06 160/120
2,280,358 A * 4/1942 Tietig ..... A47H 23/06 160/120
2,281,022 A * 4/1942 Cavanaugh ..... A47H 23/06 160/237
3,789,904 A * 2/1974 Takazawa ..... A47H 23/06 160/120
3,980,122 A * 9/1976 Takazawa ..... E06B 9/64 160/120
6,189,592 B1 * 2/2001 Domel ..... E06B 9/24 160/241
7,174,940 B2 * 2/2007 Nien ..... E06B 9/42 160/120
7,806,160 B2 * 10/2010 Byeon ..... E06B 9/40 160/11
2012/0000617 A1 * 1/2012 Chu ..... E06B 9/24 160/349.1

* cited by examiner

*Primary Examiner* — David Purol
(74) *Attorney, Agent, or Firm* — Alan D. Kamrath; Kamrath IP Lawfirm, P.A.

(57) ABSTRACT

A roller shade includes a frame unit (1), a guiding unit (2) and a light regulating shading member (3). The light regulating shading member presents a two-layer state and has a plurality of light shading sections (31) and a plurality of light permeating sections (32). Each of the light permeating sections is provided with a plurality of through holes (321). When the light permeating sections at one layer of the light regulating shading member align with the light permeating sections at the other layer of the light regulating shading member, ambient sunlight passes through the through holes of each of the light permeating sections. When the light shading sections align with the light permeating sections, each of the light shading sections covers the through holes of each of the light permeating sections to interrupt the sunlight.

8 Claims, 5 Drawing Sheets

ROLLER SHADE WITH A LIGHT REGULATING FUNCTION

BACKGROUND OF THE INVENTION

1. Field of the Invention

The present invention relates to a window accessory and, more particularly, to a roller shade.

2. Description of the Related Art

A conventional suspension shade comprises a shading cloth having an upper end, a lower end and a cloth face, at least one magnetic unit mounted on a determined portion of the cloth face of the shading cloth, and at least one metallic unit mounted on the cloth face of the shading cloth with a determined distance being defined between the metallic unit and the magnetic unit. When in use, the metallic unit is attracted by and attached to the magnetic unit to fold the shading cloth upward so as to allow entrance of the ambient sunlight into the house. On the contrary, the metallic unit is detached from the magnetic unit to expand the shading cloth downward so that the shading cloth hangs down to provide a light shading effect. However, the light shading function of the conventional shade is fixed and cannot be regulated, thereby limiting lightness of the house.

BRIEF SUMMARY OF THE INVENTION

The primary objective of the present invention is to provide a roller shade with a light regulating function.

In accordance with the present invention, there is provided a roller shade comprising a frame unit, a guiding unit disposed under the frame unit, and a light regulating shading member mounted between the frame unit and the guiding unit. The frame unit includes a fixed track, two side brackets mounted on two opposite ends of the fixed track respectively, a rotary wheel module mounted in one of the two side brackets, and a drive shaft rotatably mounted between the two side brackets and connected with the rotary wheel module. The guiding unit includes two side walls, a weight bar mounted between the two side walls, a winding rod mounted between the two side walls and disposed above the weight bar, and a passage defined between the weight bar and the winding rod. The winding rod of the guiding unit is disposed at a rotatable state. The light regulating shading member has a first end secured to the fixed track of the frame unit and a second end extending through the passage of the guiding unit and connected with the drive shaft of the frame unit so that the light regulating shading member presents a two-layer state. The second end of the light regulating shading member abuts the winding rod of the guiding unit and is wound around the drive shaft of the frame unit. The light regulating shading member is provided with a plurality of light shading sections and a plurality of light permeating sections located between the light shading sections. The light shading sections and the light permeating sections are arranged in an alternating manner. Each of the light permeating sections is provided with a plurality of through holes.

When the guiding unit is pulled downward, the winding rod of the guiding unit and the drive shaft of the frame unit are rotated, and the light regulating shading member is driven to hang down to present an expanded state. When the light permeating sections at one of two layers of the light regulating shading member align with the light permeating sections at the other one of the two layers of the light regulating shading member, sunlight from the ambient environment passes through the through holes of each of the light permeating sections. When the light shading sections at one of the two layers of the light regulating shading member align with the light permeating sections at the other one of the two layers of the light regulating shading member, each of the light shading sections covers the through holes of each of the light permeating sections to interrupt the sunlight from the ambient environment, thereby achieving a light shading effect.

According to the primary advantage of the present invention, the light regulating shading member has a two-layer form and can be adjusted to allow entrance of a part of the sunlight and to shade a part of the sunlight so as to regulate the light shading effect and to change the indoor lightness.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
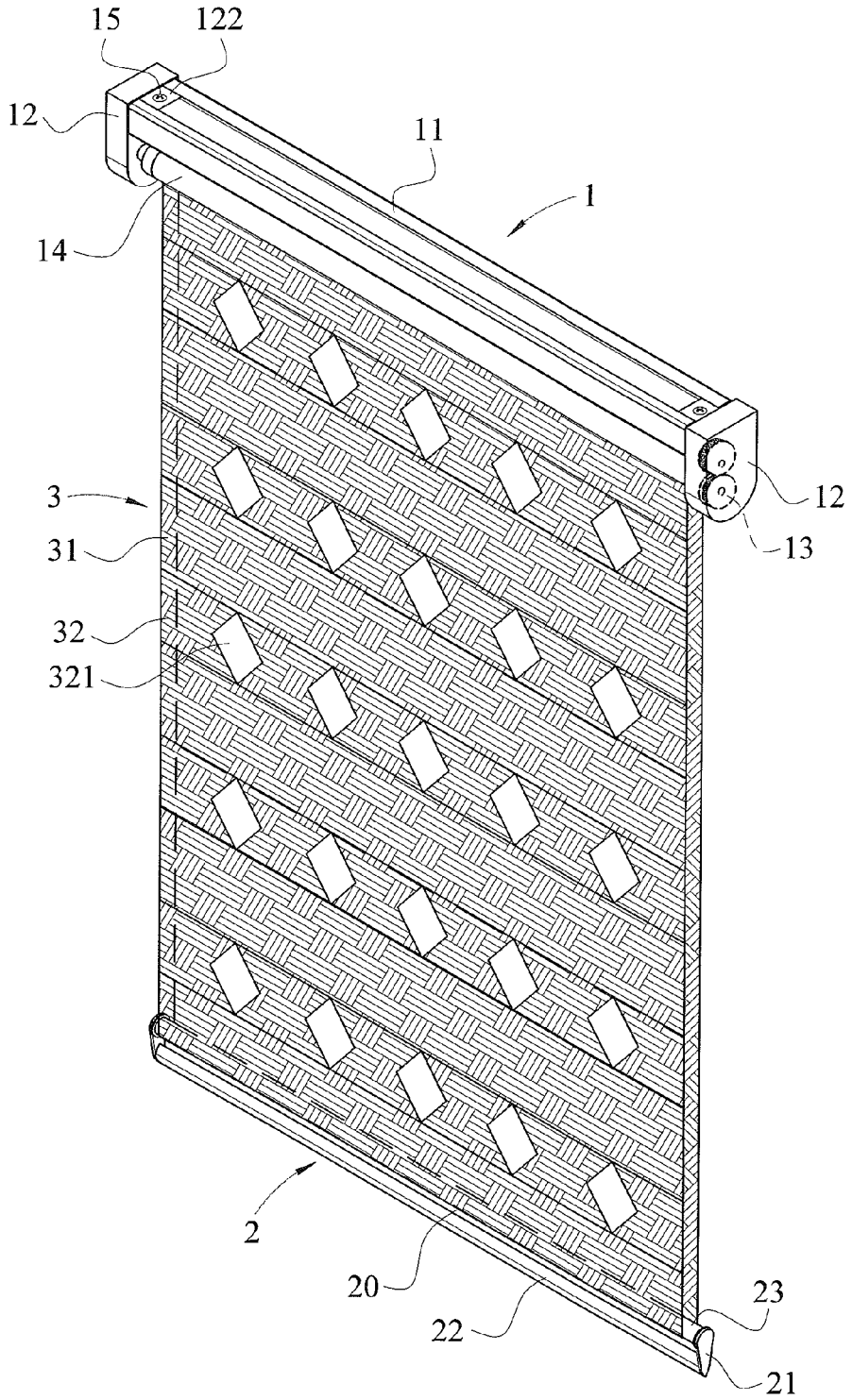
FIG. 1 is a perspective view of a roller shade in accordance with the preferred embodiment of the present invention.
Figure 2:
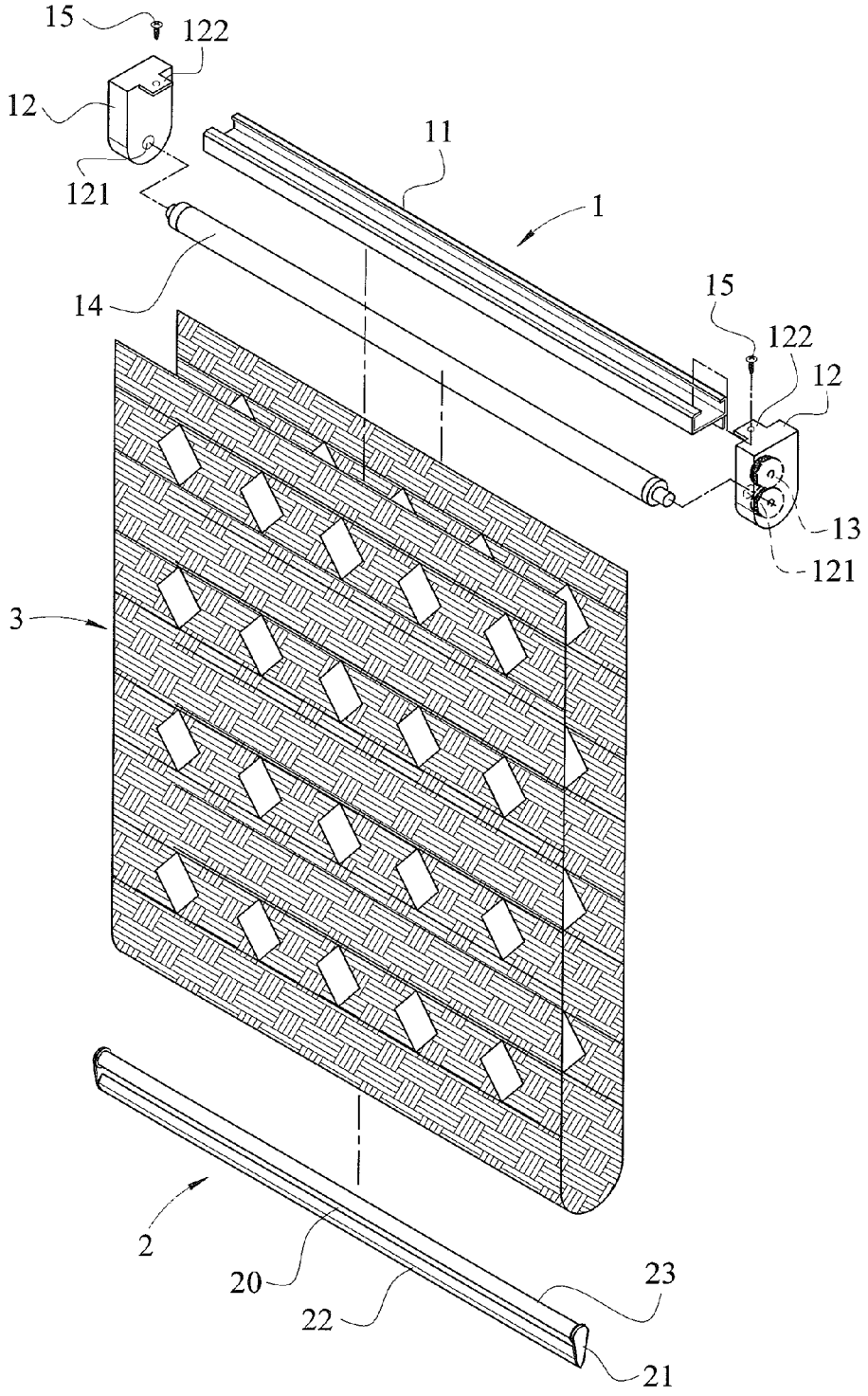
FIG. 2 is an exploded perspective view of the roller shade in accordance with the preferred embodiment of the present invention.
Figure 3:
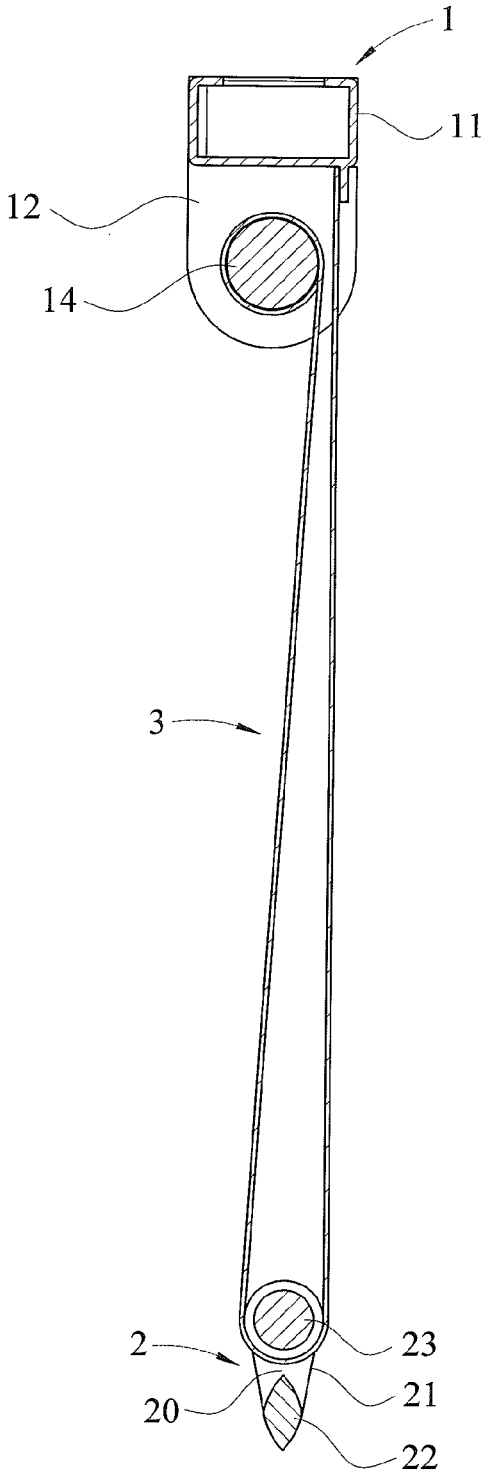
FIG. 3 is a side cross-sectional view of the roller shade as shown in FIG. 1.

Referring to the drawings and initially to FIGS. 1-3, a roller shade in accordance with the preferred embodiment of the present invention comprises a frame unit 1, a guiding unit 2 disposed under the frame unit 1, and a light regulating shading member 3 mounted between the frame unit 1 and the guiding unit 2.

The frame unit 1 includes a fixed track 11, two side brackets 12 mounted on two opposite ends of the fixed track 11 respectively, a rotary wheel module 13 mounted in one of the two side brackets 12, and a drive shaft 14 rotatably mounted between the two side brackets 12 and connected with the rotary wheel module 13. Each of the two side brackets 12 has a face provided with a shaft hole 121. The drive shaft 14 has two opposite ends each pivotally mounted in the shaft hole 121 of each of the two side brackets 12. One of the two opposite ends of the drive shaft 14 is connected with the rotary wheel module 13. The rotary wheel module 13 is used to drive the drive shaft 14 and the light regulating shading member 3 so that the light regulating shading member 3 is pulled downward or folded upward. Each of the two side brackets 12 has a top provided with a locking plate 122 extending outward. The locking plate 122 of each of the two side brackets 12 is locked onto the fixed track 11 by a fastener member 15.

The guiding unit 2 includes two side walls 21, a weight bar 22 mounted between the two side walls 21, a winding rod 23 mounted between the two side walls 21 and disposed above the weight bar 22, and a passage 20 defined between the weight bar 22 and the winding rod 23. The weight bar 22 of the guiding unit 2 is disposed at a fixed state. The winding rod 23 of the guiding unit 2 is disposed at a rotatable state.

The light regulating shading member 3 has a first end secured to the fixed track 11 of the frame unit 1 and a second end extending through the passage 20 of the guiding unit 2 and connected with the drive shaft 14 of the frame unit 1 so that the light regulating shading member 3 presents a two-layer state. The second end of the light regulating shading member 3 abuts the winding rod 23 of the guiding unit 2 and is wound around the drive shaft 14 of the frame unit 1. The light regulating shading member 3 is provided with a plurality of light shading sections 31 and a plurality of light permeating sections 32 located between the light shading sections 31. The light shading sections 31 and the light permeating sections 32 are set in a longitudinal array and are arranged in an alternating manner. Each of the light permeating sections 32 is provided with a plurality of through holes 321. The through holes 321 of each of the light permeating sections 32 are set in a transverse array and are equally distant from each other. In practice, when the guiding unit 2 is pulled downward, the winding rod 23 of the guiding unit 2 and the drive shaft 14 of the frame unit 1 are rotated, and the light regulating shading member 3 is driven to hang down to present an expanded state.

Figure 4:
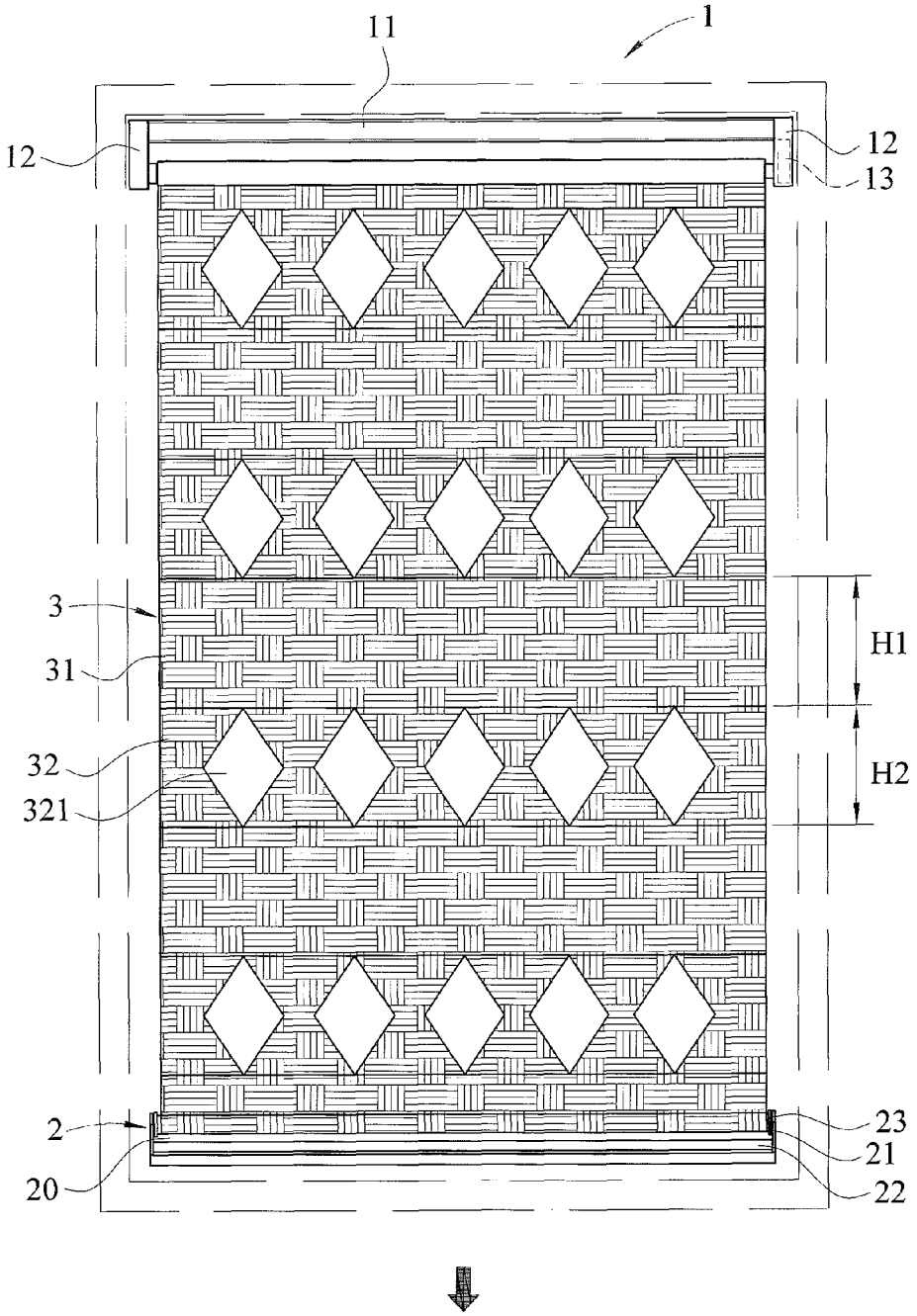
FIG. 4 is a front operational view of the roller shade as shown in FIG. 1 in use.
Figure 5:
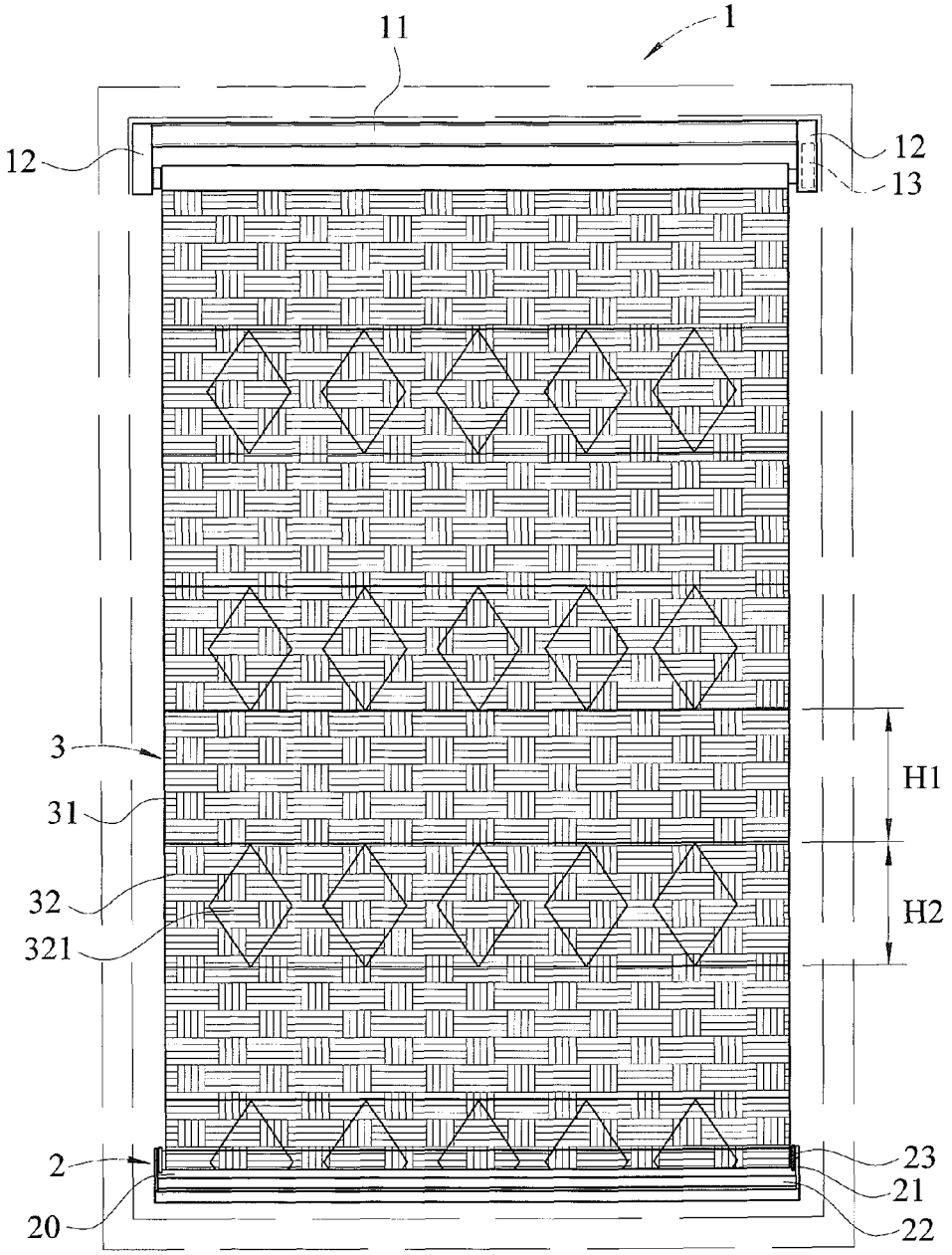
FIG. 5 is another front operational view of the roller shade as shown in FIG. 1 in adjustment.

As shown in FIGS. 4 and 5, each of the light shading sections 31 has a height "H1" greater than a height "H2" of each of the light permeating sections 32 and has an area greater than that of each of the light permeating sections 32, so that each of the light shading sections 31 can efficiently cover the through holes 321 of each of the light permeating sections 32.

In the preferred embodiment of the present invention, the light regulating shading member 3 presents a light impermeable state. Preferably, the light regulating shading member 3 is made of cloth material, plastics or polyester fiber. In addition, each of the through holes 321 of each of the light permeating sections 32 presents a geometric shape. Preferably, each of the through holes 321 of each of the light permeating sections 32 has a diamond shape, a square shape, a circular shape, an elliptic shape, a triangular shape or a polygonal shape. Moreover, each of the through holes 321 of each of the light permeating sections 32 presents a pattern, a stripe, a corrugated form, a character, a human shape, an animal shape, a plant shape or a cartoon shape. Further, the rotary wheel module 13 is replaced by an elastic shaft module. The elastic shaft module is mounted in one of the two opposite ends of the drive shaft 14 and is connected with the shaft hole 121 of one of the two side brackets 12.

In operation, referring to FIGS. 4 and 5 with reference to FIGS. 1-3, when the guiding unit 2 is pulled downward, the winding rod 23 of the guiding unit 2 and the drive shaft 14 of the frame unit 1 are rotated, and the light regulating shading member 3 is driven to hang down to present an expanded state. In such a manner, when the light permeating sections 32 at one of the two layers of the light regulating shading member 3 align with the light permeating sections 32 at the other one of the two layers of the light regulating shading member 3 as shown in FIG. 4, the sunlight from the ambient environment passes through the through holes 321 of each of the light permeating sections 32 into the interior of a house. On the contrary, when the light shading sections 31 at one of the two layers of the light regulating shading member 3 align with the light permeating sections 32 at the other one of the two layers of the light regulating shading member 3 as shown in FIG. 5, each of the light shading sections 31 covers the through holes 321 of each of the light permeating sections 32 to interrupt the sunlight from the ambient environment, thereby achieving a light shading effect. In addition, each of the light shading sections 31 can be adjusted to partially cover the through holes 321 of each of the light permeating sections 32 to allow entrance of a part of the sunlight from the ambient environment so as to regulate the light shading effect.

Accordingly, the light regulating shading member 3 has a two-layer form and can be adjusted to allow entrance of a part of the sunlight and to shade a part of the sunlight so as to regulate the light shading effect and to change the indoor lightness.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A roller shade comprising:

a frame unit;

a guiding unit disposed under the frame unit; and a light regulating shading member mounted between the frame unit and the guiding unit;

wherein:

the frame unit includes a fixed track, two side brackets mounted on two opposite ends of the fixed track respectively, a rotary wheel module mounted in one of the two side brackets, and a drive shaft rotatably mounted between the two side brackets and connected with the rotary wheel module;

the guiding unit includes two side walls, a weight bar mounted between the two side walls, a winding rod mounted between the two side walls and disposed above the weight bar, and a passage defined between the weight bar and the winding rod;

the weight bar of the guiding unit is disposed at a fixed state between the two side walls;

the winding rod of the guiding unit is disposed at a rotatable state;

the light regulating shading member has a first end secured to the fixed track of the frame unit and a second end extending through the passage of the guiding unit and connected with the drive shaft of the frame unit so that the light regulating shading member presents a two-layer state;

the second end of the light regulating shading member abuts the winding rod of the guiding unit and is wound around the drive shaft of the frame unit;

the light regulating shading member is provided with a plurality of light shading sections and a plurality of light permeating sections located between the light shading sections;

the light shading sections and the light permeating sections are arranged in an alternating manner;

each of the light permeating sections is provided with a plurality of through holes;

each of the light shading sections has a height greater than that of each of the light permeating sections and has an area greater than that of each of the light permeating sections, so that each of the light shading sections efficiently covers through holes of each of the light permeating sections;

when the guiding unit is pulled downward, the winding rod of the guiding unit and the drive shaft of the frame unit are rotated, and the light regulating shading member is driven to hang down to present an expanded state;

when the light permeating sections at one of two layers of the light regulating shading member align with the light permeating sections at the other one of the two layers of the light regulating shading member, sunlight from the ambient environment passes through the through holes of each of the light permeating sections; and when the light shading sections at one of the two layers of the light regulating shading member align with the light permeating sections at the other one of the two layers of the light regulating shading member, each of the light shading sections covers the through holes of each of the light permeating sections to interrupt the sunlight from the ambient environment, thereby achieving a light shading effect.

2. The roller shade of claim 1, wherein each of the through holes of each of the light permeating sections presents a geometric shape.

3. The roller shade of claim 1, wherein each of the through holes of each of the light permeating sections has a diamond shape, a square shape, a circular shape, an elliptic shape, a triangular shape or a polygonal shape.

4. The roller shade of claim 1, wherein each of the through holes of each of the light permeating sections presents a pattern, a stripe, a corrugated form, a character, a human shape, an animal shape, a plant shape or a cartoon shape.

5. The roller shade of claim 1, wherein the light regulating shading member presents a light impermeable state.

6. The roller shade of claim 1, wherein the light regulating shading member is made of cloth material, plastics or polyester fiber.

7. The roller shade of claim 1, wherein the drive shaft is located at a position lower than that of the fixed track.

8. The roller shade of claim 7, wherein the first end of the light regulating shading member secured to the fixed track of the frame unit is higher than the second end of the light regulating shading member connected with the drive shaft of the frame unit.

* * * * *